US005212882A

United States Patent [19]

Hamonko et al.

[11] Patent Number: 5,212,882

[45] Date of Patent: May 25, 1993

[54] TOOL FOR CONNECTING CONDUCTORS TO IDC TERMINALS

[75] Inventors: Michael R. Hamonko, Harrisburg; Douglas J. Leiby, Enola, both of Pa.

[73] Assignee: AMP Incorporated, Harrisburg, Pa.

[21] Appl. No.: 842,825

[22] Filed: Feb. 27, 1992

[51] Int. Cl.[5] ..... H01R 43/04

[52] U.S. Cl. ..... 29/749; 29/751; 81/350; 81/371

[58] Field of Search ..... 29/749, 751, 566.3, 29/566.4; 81/350, 351, 368-371

[56] References Cited

U.S. PATENT DOCUMENTS 3,800,390 2/1973 Johnston .
3,803,695 12/1972 Tucci .
4,203,196 5/1980 Fukushima et al. ..... 29/749 X
4,318,215 3/1982 Holt ..... 29/749 X

*Primary Examiner*—Carl E. Hall
*Attorney, Agent, or Firm*—James M. Trygg; Robert J. Kapalka

[57] ABSTRACT

A manually operated tool for terminating electrical conductors to insulation displacement contacts in a connector. The tool includes a connector holder and a pair of hingeable jigs for holding and positioning the conductors adjacent the connector terminals for shearing to length and inserting. Shearing and insertion assemblies are secured to two arms which are pivoted toward the connector until the assemblies engage and terminate the conductors. A pair of handles and a pair of toggle links are pivotally attached to the two arms for effecting a mechanical advantage during the shearing and insertion process.

4 Claims, 5 Drawing Sheets

TOOL FOR CONNECTING CONDUCTORS TO IDC TERMINALS

The present invention is related to a tool for electrically connecting a plurality of conductors to insulation displacement contact terminals in a connector and more particularly to an improved linkage for increasing the amount of force available at the point of insertion.

BACKGROUND OF THE INVENTION

Tools for connecting electrical conductors to IDC terminals are disclosed in U.S. Pat. No. 3,800,390 which issued Apr. 2, 1974 to Johnston and U.S. Pat. No. 3,803,695 which issued Apr. 16, 1974 to Tucci, both of which are incorporated by reference as though set forth verbatim herein. The tools disclosed in these two patents are similar in that they include a connector holder, a pair of pivotal jigs having comb members for positioning and holding the conductors to be terminated, and a pair of arms, each carrying a tooling plate containing conductor insertion elements and shearing edges. Each arm has a handle for manually gripping and pivoting the arms so that the tooling plate elements engage and terminate the conductors in the IDC terminals of the connector. Such tools, typically, are suitable for shearing and inserting up to about 50 conductors of 24 gage wire. This combination requires an actuation force on the handles of about 30 pounds, which is about the maximum force that can be reasonably expected of an average operator over the course of a normal work day. When the connector has more than 50 positions or the conductors are greater than 24 gage or the insulation is particularly firm, and the combination results in a required actuation force substantially greater than 30 pounds, these tools are not suitable.

What is needed is a manually actuatable tool for terminating these larger size connectors and larger gage wires while keeping the required operator force below 30 pounds without sacrificing ease and speed of operation of the tool.

SUMMARY OF THE INVENTION

The present invention is a tool for connecting electrical conductors to insulation displacement contact terminals secured in an insulating connector housing. The tool includes a base and a holding means for securely holding the connector housing with respect to the base. A conductor positioning means is provided, which is pivotally attached to the base, for positioning the conductors adjacent and in alignment with their respective contact terminals for insertion when the positioning means is in a closed position. The conductors are remote from the contact terminals when the positioning means is in an open position. First and second arms are pivotally attached to the base and arranged to move to a closed position adjacent the positioning means and an open position away from the positioning means. A pair of insertion bars are provided, one being attached to each arm so that when the arms are pivoted into their closed position the bars engage and insert the conductors into their respective contact terminals. A handle and toggle means is provided for causing the arms to move to their closed position when manually actuated by a force less than the force required to move the arms to their closed position.

DESCRIPTION OF THE PREFERRED EMBODIMENT

Figure 1:
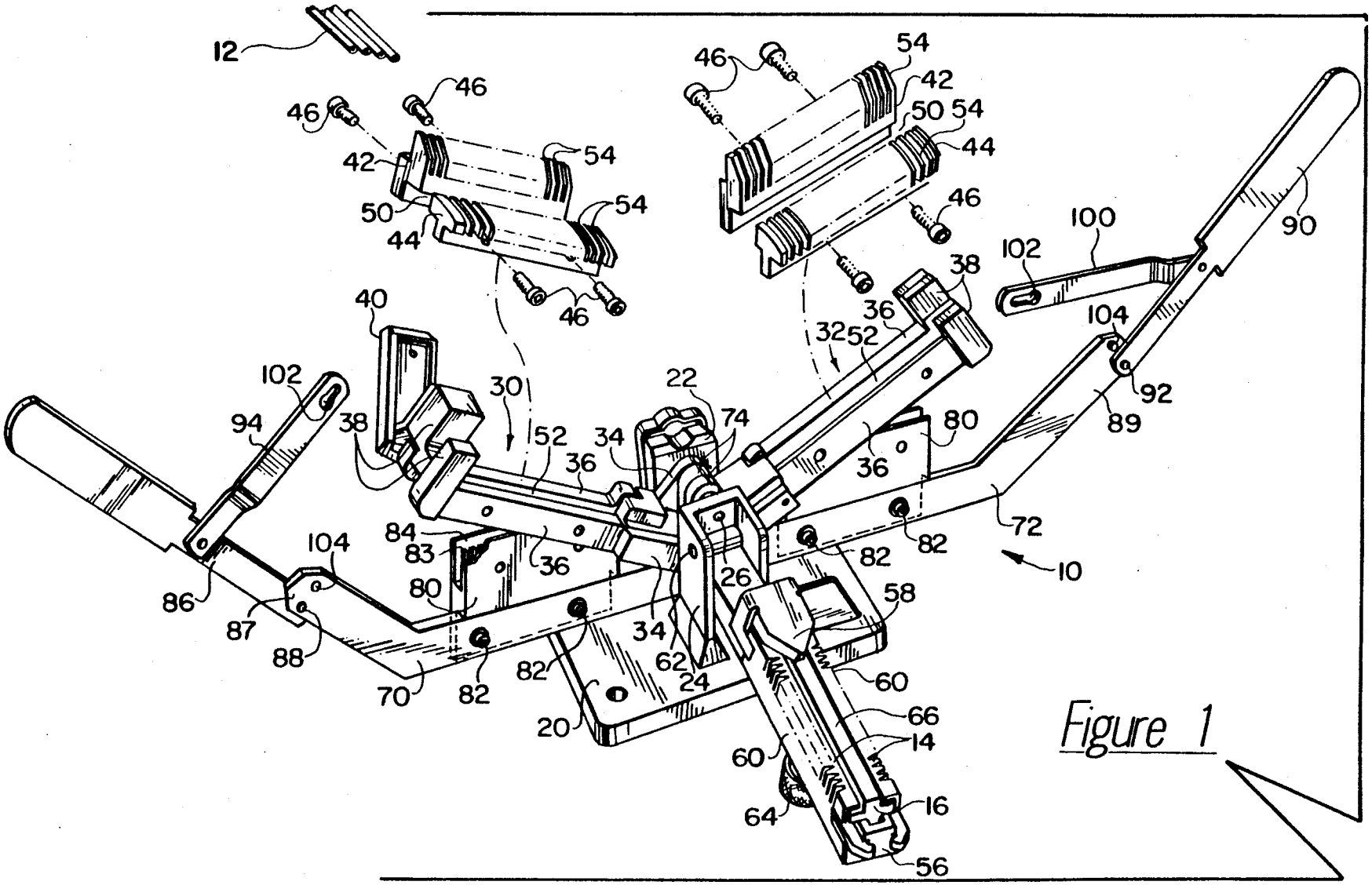
FIG. 1 is an isometric view of a tool incorporating the teachings of the present invention.
Figure 2:
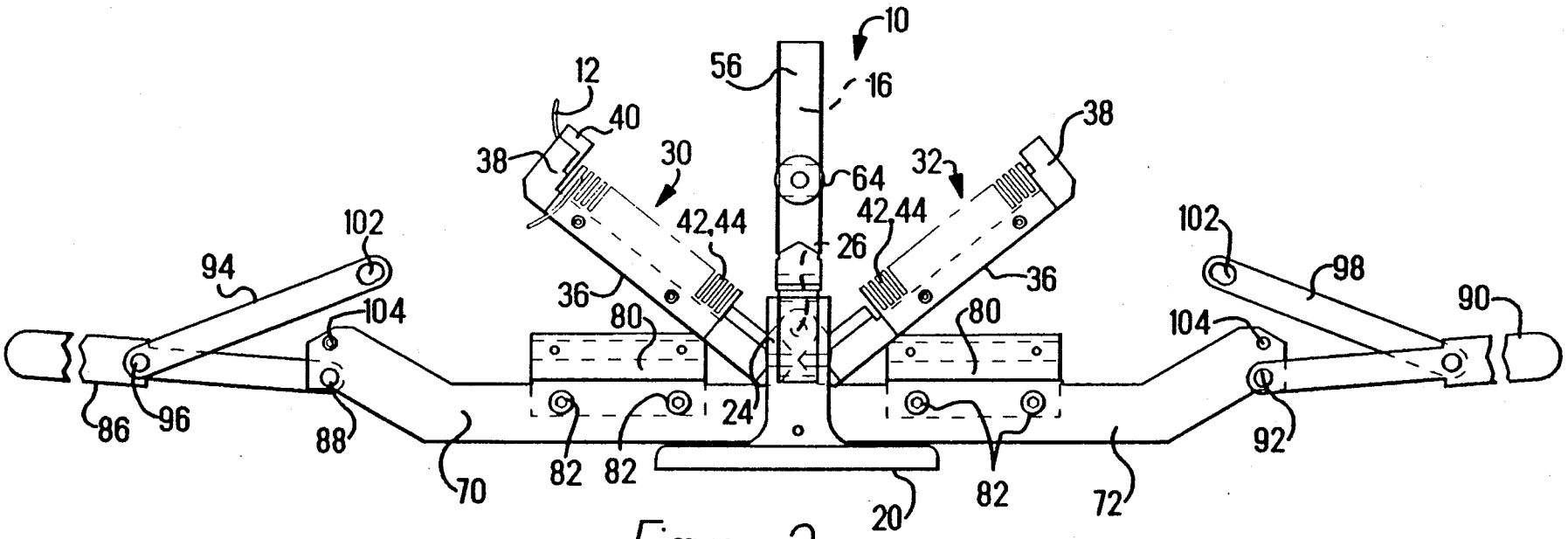
FIG. 2 is a front view of the tool of FIG. 1.

There is shown in FIGS. 1 and 2 a manually actuatable tool 10 for terminating a plurality of electrical conductors 12 to insulation displacement contact terminals 14 in a connector housing 16. The tool 10 includes a base 20 having first and second spaced brackets 22 and 24 projecting upwardly therefrom. A pivot pin 26 is secured in a hole in each of the brackets 22 and 24 spanning the space therebetween and being substantially parallel to the base 20. A left jig 30 and a right jig 32 are pivotally attached to the base 20 by means of the pivot pin 26. The jig 30 includes a pair of L-shaped legs 34, each having a slip fit hole through which the pivot pin 26 projects, and a pair of spaced apart plates 36. Similarly the jig 32 includes a pair of L-shaped legs 34 for pivotal movement about the pin 26, and a pair of spaced apart plates 36. The jigs 30 and 32 are arranged to pivot about the pivot pin 26 to an open position, shown in FIG. 2 and to a closed position, shown in FIG. 5. Each jig includes intermatable fingers 38 which engage and align the two jigs when in their closed position. A latch 40 is hingedly attached to the free end of the plates 36 of the jig 30, as best seen in FIG. 1. When the two jigs are closed, the latch 40 may then be closed to latchingly engage the fingers 38 of the jig 32 thereby securing the two jigs in their closed position. A pair of comb members 42 and 44 are attached to the outer surfaces of the two plates 36 of the two jigs 30 and 32 by means of the screw fasteners 46. When the comb members 42 and 44 are attached to the plates 36, a space 50 is maintained therebetween in alignment with a space 52 that is maintained between the plates 36 for a purpose that will be disclosed below. Each of the comb members 42 and 44 include a plurality of slots 54 which are sized to closely accept the conductors 12 and to have a center to center spacing that corresponds to the center to center spacing of the contact terminals 14 in the connector housing 16.

A connector holder 56 having a stop 58 and a pair of sides 60 which form a channel for receiving the connector 16, is pivotally attached to the second bracket 24 by means of the pin 62. A thumb screw 64 is threaded into the holder 56 and abuts a pressure plate 66 held captive therein. A connector 16 is inserted into the channel until it rests against the stop 58, and the thumb screw 64 tightened until the connector 16 is secured within the channel of the connector holder 56, as shown in FIG. 1. The holder 56 may then be pivoted upwardly, about the pin 62, to a vertical position shown in FIG. 2. The comb members 42 and 44 are positioned on the plates 36 so that when the two jigs 30 and 32 are latched closed and are adjacent the connector 16, the slots 54 of the comb members are in substantially exact alignment with the contact terminals 14, as best seen in FIG. 3.

First and second arms 70 and 72, each having an L-shaped end 74, are pivotally attached to the base 20 by means of the pivot pin 26, the L-shaped ends 74 being interleaved between the L-shaped legs 34 of the two jigs 30 and 32. A conductor shear and insertion assembly 80 is secured to each arm 70 and 72 by means of screw fasteners 82, as best seen in FIGS. 1 and 2. Each shear and insertion assembly 80 includes an array of insertion pins 83 and a wire shearing edge 84 which trims the individual conductors 12 to length prior to insertion. The thickness of the shear and insertion assembly 80 is slightly less than the width of the spaces 50 and 52 thereby allowing the assemblies 80 to freely enter these spaces when the arms 70 and 72 are pivoted to the position shown in FIG. 3. In this position the insertion pins 83 are in alignment with the individual slots 54 and respective contact terminals 14, the insertion pins 83 already having engaged the lower conductors 12 and moved them a short distance within the slots 54 toward the connector 16 . For a more detailed description of the construction and operation of the tool 10, up to this point, please see the above referenced '390 patent.

Figure 3:
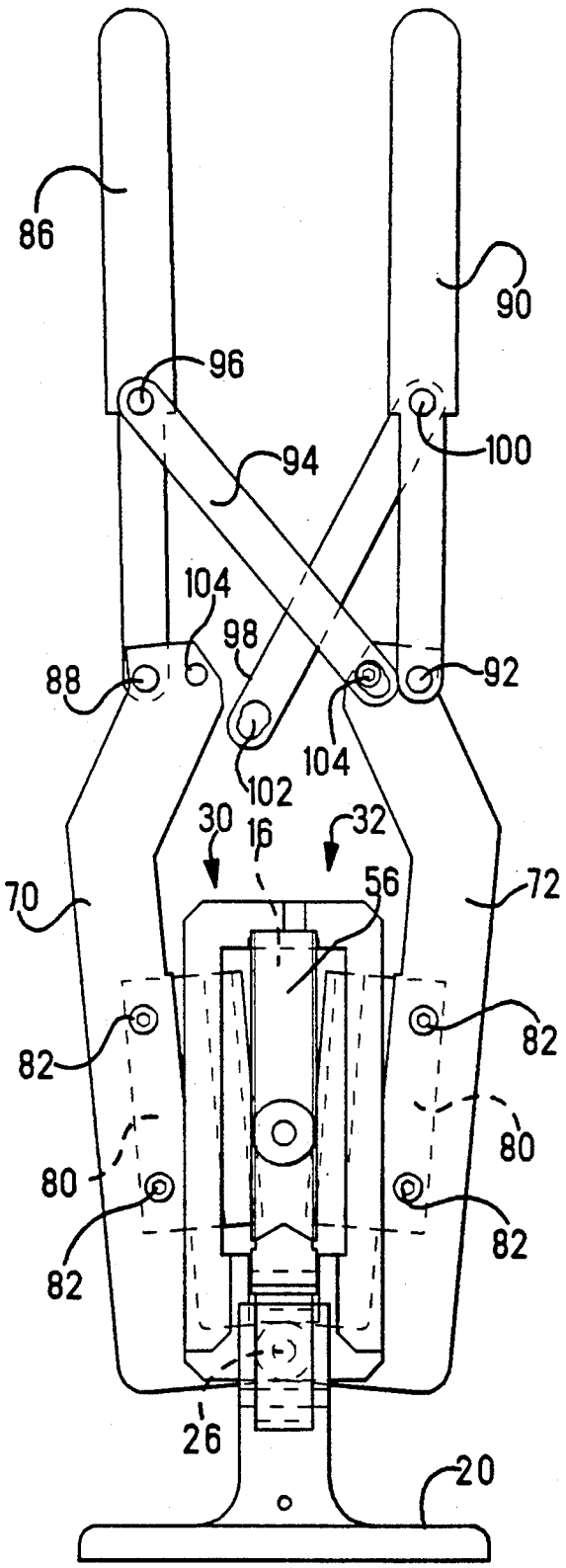
FIGS. 3, 4, and 5 are front views of the tool of FIG. 1 showing the tool in various operating positions.

As shown in FIGS. 1, 2, and 3, a first handle 86 is pivotally attached to the free end of the first arm 70 at a first pivot point 88 and a second handle 90 is pivotally attached to the free end of the second arm 72 at a second pivot point 92, the first and second pivot points being remote from the base. A first toggle link 94 is pivotally attached at one end to the first handle 86 at a point 96 and a second toggle link 98 is pivotally attached at one end to the second handle 90 at a point 100. The other end of each toggle link 94 and 98 includes an elongated opening 102 that is somewhat narrow near the end of the link and slightly wider toward the other end for a purpose that will become apparent. A shoulder screw 104 is securely threaded into the end of each of the first and second arms 70 and 72 adjacent the pivot points 88 and 92 as shown in FIGS. 1, 2, and 3. The elongated openings 102 are sized so that the wider end will slip over the head of the shoulder screw 104 while the narrow end will be slightly larger than the diameter of the shoulder but smaller than the diameter of the head. The height of the shoulder is slightly greater than the thickness of the toggle link 94,98. The lengths of the first and second toggle links 94 and 98 are chosen so that when the first and second arms 70 and 72 and their respective handles 86 and 90 are in the position shown in FIG. 3, the free end of the first toggle link 94 may be pivoted toward the second arm 72 and its opening 102 slipped over the head of the shoulder screw 104. At this point the free end of the second toggle link may be pivoted toward the first arm 70 and its opening 102 slipped over the head of the shoulder screw 104.

Figure 4:
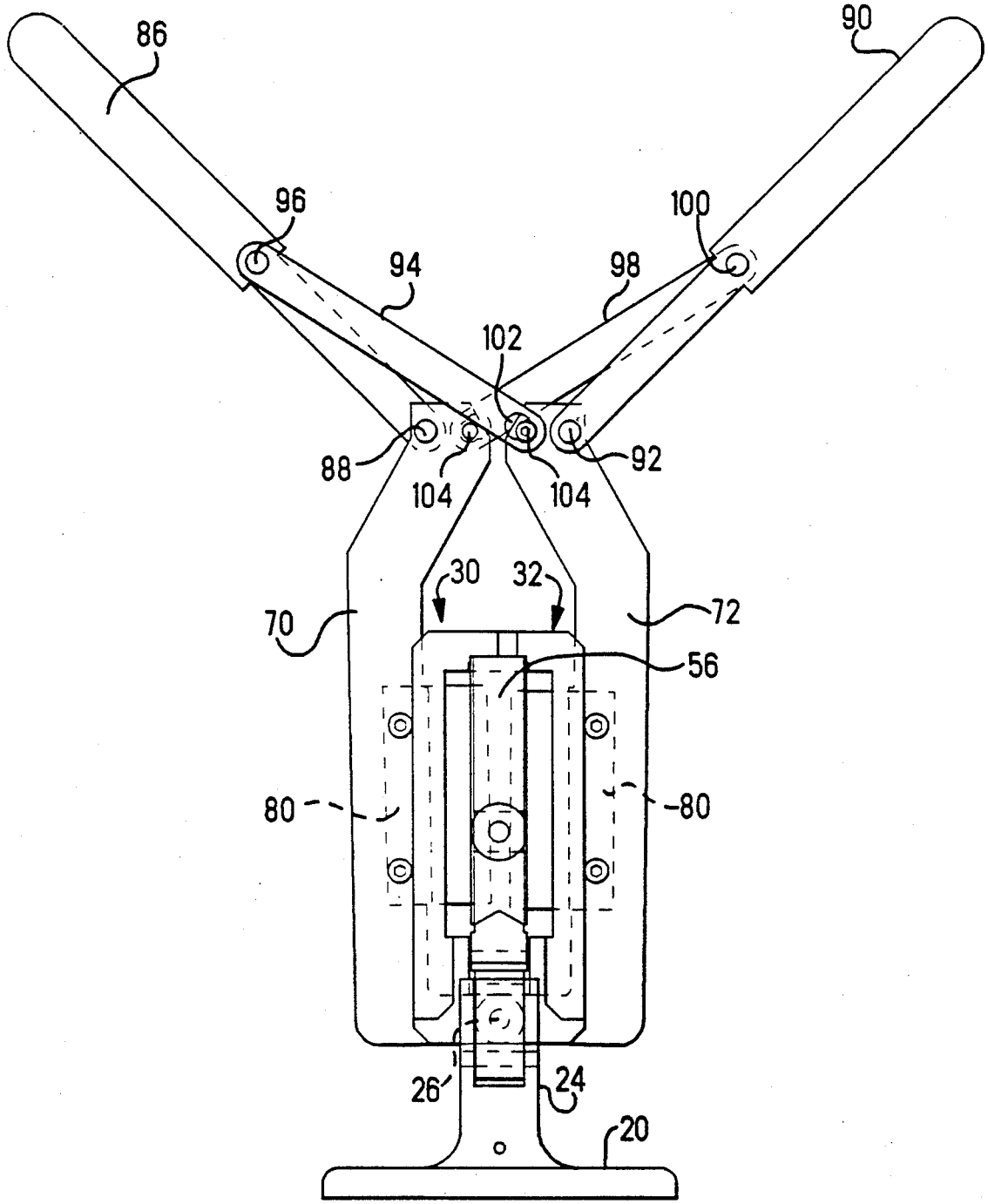
Figure 5:
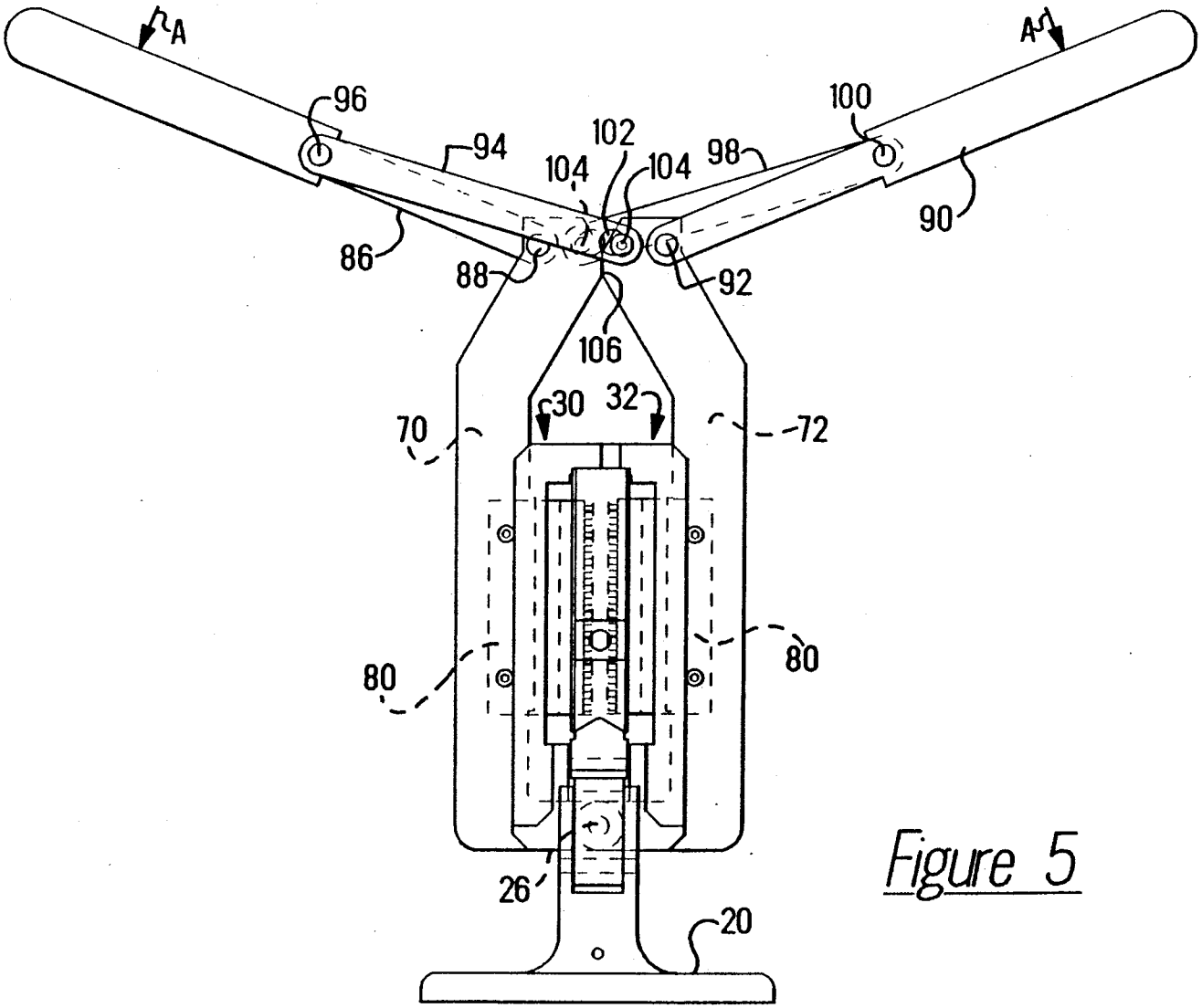

By manually moving the first and second handles apart, as shown in FIG. 4, the narrow ends of the openings 102 engage the diameters of the shoulder portions of their respective shoulder screws 104 with the larger diameter screw heads overhanging and holding the free ends of the toggle links 94 and 98 captive. As the two handles are moved further apart, the first and second arms are caused to move toward each other thereby carrying the shear and insertion assemblies 80 further toward the connector 16, shearing the conductors 12 to length and beginning the insertion of the conductors into their respective contact terminals 14. Movement of the two handles 86 and 90 continues until the two arms 70 and 72 mutually abut at 106 as shown in FIG. 5. At this point the conductors 12 are fully inserted into their respective contact terminals 14 The handles are then returned to their position shown in FIG. 3, the toggle links removed from their respective shoulder screws 104 and the arms 70 and 72 and the jigs 30 and 32 moved to their open positions as shown in FIG. 2. The connector 16 with terminated conductors 12 is then removed and the process repeated.

The distance between the pivot points, the positions of the shoulder screws 104, and the length of the toggle links are chosen so that a manually applied force of about 22 pounds urging the handles 86 and 90 apart will result in an insertion force by the shear and insertion assemblies 80 of about 490 pounds at the center of the connector 16. In the present example the distance between the pivots 88 and 96, and 92 and 100, is 3 inches and the distance between the pivot 96 and the shoulder screw 104 of the arm 72 is 4 inches with the link 94 coupled to the shoulder screw. Similarly, the distance between the pivot point 100 and the other shoulder screw is 4 inches with the link 98 coupled. The operator force is assumed to be applied to the handles about 2¼ inches from the pivots 96 and 100 as indicated at the arrows A in FIG. 5. It will be appreciated by those skilled in the art that variations in these dimensions may be advantageously utilized in the practice of the present invention. Additionally, the pivot points 88 and 92 may include the shoulder screws 104 or equivalents thereof so that the openings 102 of the links 94 and 98 may be coupled directly to the pivot points 88 and 92.

An important advantage of the present invention is that a relatively high insertion and shearing force is achieved with only a small actuating force required by the operator while permitting relatively fast movement of the arms of the tool up to the point where the higher force is needed. This permits termination of larger connectors having more contact positions as well as larger gage conductors. Additionally, the toggle links are designed to easily and quickly couple to and decouple from the arms of the tool. This results in substantially no degradation of the time required to perform a complete cycle of the tool with respect to prior art tools.

We claim:

1. A tool for connecting a plurality of electrical conductors to insulation displacement contact terminals secured in an insulating connector housing, comprising:

(a) a base;

(b) holding means for securely holding said insulating connector housing with respect to said base;

(c) conductor positioning means pivotally attached to said base for positioning said conductors adjacent their respective contact terminals in alignment therewith for insertion thereinto when in a closed position and remote therefrom when in an open position;

(d) first and second arms each having a free end and an attached end, said attached end being pivotally attached to said base and arranged to move to a closed position adjacent said positioning means and an open position away therefrom;

(e) a pair of wire insertion bars, one said bar attached to each of said first and second arms so that when said arms are pivoted into said closed position said bars engage and insert said conductors into said contact terminals;

(f) means for effecting movement of said arms to said closed position from a position adjacent said closed position, comprising:

(1) a first handle pivotally attached to said first arm at a first pivot point near said free end thereof, and a second handle pivotally attached to said second arm at a second pivot point near said free end thereof;

(2) a first toggle link pivotally attached at one end to said first handle and a second toggle link pivotally attached at one end to said second handle;

(3) releasable attaching means for coupling the other end of said first toggle link to said second arm near said free end thereof, and for coupling the other end of said second toggle link to said first arm near said free end thereof, whereby manual actuation of said first and second handles causes said first and second toggle links to urge said first and second arms together with a mechanical advantage such that a force required for said manual actuation is less than a force required for said movement of said arms to said closed position.

2. A tool according to claim 1 wherein said releasable attaching means comprises:

(a) a first shoulder screw threaded into said free end of said first arm having a shoulder length greater than the thickness of said first toggle link and a second shoulder screw threaded into said free end of said second arm having a shoulder length greater than the thickness of said second toggle link;

(b) a first opening in said other end of said first toggle link that is larger than the diameter of the head of said second shoulder screw and a second opening in said other end of said second toggle link that is larger than the diameter of the head of said first shoulder screw, wherein said first and second toggle links have a length so that when said first and second arms are adjacent their closed position, said first opening of said first link may be slipped over the head of said second shoulder screw to engage the shoulder diameter thereof and said second opening of said second link may be slipped over the head of said first shoulder screw to engage the shoulder diameter thereof.

3. A tool according to claim 2 wherein each of said first and second openings is elongated and has one end that is wider than the other end.

4. A tool according to claim 1 wherein said coupling of said first toggle link is effected at said second pivot point of said second arm and said coupling of said second toggle link is effected at said first pivot point of said first arm.

* * * * *